United States Patent [19]

Fenn, III et al.

[11] 4,410,411

[45] Oct. 18, 1983

[54] DIMENSIONALLY STABLE ASBESTOS DIAPHRAGMS

[75] Inventors: Robert W. Fenn, III, Painesville; Emory J. Pless, Cleveland Heights; Richard L. Harris, Painesville; Kevin J. O'Leary, Cleveland Heights, all of Ohio

[73] Assignee: Diamond Shamrock Corporation, Dallas, Tex.

[21] Appl. No.: 324,508

[22] Filed: Jan. 17, 1973

[51] Int. Cl.[3] ..... C25B 13/06; C25B 13/07

[52] U.S. Cl. ..... 204/283; 204/296

[58] Field of Search ..... 162/155, 224, 226, 22, 162/168 R; 204/282, 283, 296, 295, 288 T; 156/62.2, 196, 283

[56] References Cited

U.S. PATENT DOCUMENTS

| | | | |
|---|---|---|---|
| 1,862,244 | 6/1932 | Stuart | 204/283 |
| 2,338,602 | 1/1944 | Schur | 162/166 |
| 2,526,125 | 10/1950 | Francis | 162/146 |
| 2,568,144 | 9/1951 | Cremer et al. | 428/198 |
| 2,626,213 | 1/1953 | Novak | 162/155 |
| 2,962,414 | 11/1960 | Arledter | 162/145 |
| 3,200,033 | 8/1965 | Grossteinbeck et al. | 162/146 |
| 3,320,107 | 5/1967 | Christenson et al. | 162/157 R |
| 3,369,948 | 2/1968 | Ostmann | 428/198 X |
| 3,583,891 | 6/1971 | Hacker et al. | 162/155 |
| 3,622,445 | 11/1971 | Heidweiller | 162/145 |
| 3,694,281 | 9/1972 | Leduc | 156/77 |
| 3,721,637 | 3/1973 | Schultz et al. | 260/29.6 M |
| 3,723,264 | 3/1973 | Leduc et al. . | |
| 3,989,615 | 11/1976 | Kiga et al. | 204/252 |
| 4,070,257 | 1/1978 | Motani et al. | 204/98 |
| 9,395,071 | 7/1968 | Nitzsche et al. | 162/155 |

FOREIGN PATENT DOCUMENTS

| | | |
|---|---|---|
| 2020590 | 11/1970 | Fed. Rep. of Germany . |
| 2134126 | 1/1972 | Fed. Rep. of Germany . |
| 2140714 | 3/1972 | Fed. Rep. of Germany . |
| 1336225 | 11/1973 | United Kingdom . |

*Primary Examiner*—F. Edmundson

*Attorney, Agent, or Firm*—Bruce E. Harang; William A. Skinner

[57] ABSTRACT

A dimensionally stable asbestos diaphragm is formed by direct coating on the foraminous cathode of an electrolytic cell from an asbestos fiber-particulate polymer slurry, followed by fusion of the thermoplastic polymer.

22 Claims, No Drawings

DIMENSIONALLY STABLE ASBESTOS DIAPHRAGMS

BACKGROUND OF THE INVENTION

A large number of the electrolytic cells now in existance and contemplated for future use in the production of chlorine and caustic by the electrolysis of brine are diaphragm type cells. Almost without exception, these diaphragms are formed by deposition directly on the foraminous cathode from a slurry of asbestos fibers. Such diaphragms have the serious disadvantage that under load the asbestos swells considerably, e.g., up to 800 percent, filling the anode-diaphragm gap and thus increasing cell voltage and subjecting the diaphragm itself to attrition by gas released at the now proximate anode surface.

The prior art has proposed the use of a composite asbestos-polymer sheet as a diaphragm material. However, because of the complex geometry of the majority of existing diaphragm type cells (i.e., Hooker, Diamond), such a sheet, of necessity formed exterior the cell, cannot be employed without significantly reducing the active diaphragm surface area. A filter press, or "sandwich", type cell design is required to successfully employ such sheets.

Another suggestion has been to impregnate a preformed asbestos diaphragm with a monomer or polymer solution, followed by in situ polymerization of the monomer or curing of the polymer Such a technique, however, results in the formation of a continuous polymer coating on the surface of the asbestos fibers, thus eliminating the advantages of the ion exchange and water permeable properties of the asbestos fibers. Of course, attempts to impregnate a preformed diaphragm with a particulate polymer are not uniformly successful since the asbestos mat usually acts to filter out the polymer particles on the surface thereof to no appreciable advantage.

STATEMENT OF THE INVENTION

Thus, it is an object of the present invention to provide a dimensionally stable diaphragm in an electrolytic chlor-alkali cell.

It is a further object of the present invention to provide a dimensionally stable diaphragm directly deposited on the cathode of a chlor-alkali electrolytic cell.

It is a still further object of the present invention to provide a method for the direct deposition of a dimensionally stable diaphragm on the cathode of a chlor-alkali cell.

These and further objects of the present invention will become apparent to those skilled in the art from the specification and claims that follow.

There has now been found a method of providing a hydraulically permeable dimensionally stable diaphragm on a foraminous cathode for use in a chlor-alkali electrolytic cell, which method comprises:

(1) forming a slurry of fibrous asbestos and a particulate thermoplastic polymer mechanically and chemically resistant to the cell environment, said polymer being present in an amount sufficient to prevent substantial swelling of the resultant diaphragm;

(2) inserting the cathode to be coated into said slurry and depositing a uniform mixture of asbestos fibers and particulate polymer thereon by means of a vacuum;

(3) removing the coated cathode from the slurry and subjecting same to a temperature sufficient to allow the polymer to soften and flow and cause the polymer to bind adjacent asbestos fibers together without forming a continuous polymer coating on the fiber surface; and (4) cooling the thus-coated cathode to substantially room temperature, whereby there is obtained a diaphragm, dimensionally stable under operating cell conditions, characterized by asbestos fibers bearing a discontinuous fused polymer coating thereon.

Perhaps the main advantage of such a method is that it allows the application of a superior diaphragm directly on the cathode of a conventional chlor-alkali cell. No new cell design or redesign is required. As compared to a conventional asbestos diaphragm and its use in a chlor-alkali cell, the dimensionally stable diaphragms of the present invention provide a number of other advantages. (1) Such diaphragms are found to enjoy a longer useful life without replacement. (2) Assembly, disassembly, and reassembly of the cell is facilitated since the heat treatment apparently hardens and strengthens the diaphragm, thus rendering it less susceptible to damage. (3) A significant voltage advantage arises from the fact that swelling of the diaphragm under load is limited to less than 25 percent of its original thickness. The swelling ordinarily encountered with a conventional asbestos diaphragm (up to 800 percent) increases cell voltage by filling the space in the anode-diaphragm gap, normally occupied by highly conductive brine, with the less conductive swollen asbestos. Because of this substantial absence of swelling, it is now possible to reduce the anode-diaphragm gap, and hence further lower the cell voltage, by mechanical means such as the "expandable" anodes described in U.S. Pat. No. 3,674,676. (4) The current and inefficient practice of operating a diaphragm cell on start-up for extended periods of time at a high brine flow rate, and hence a low caustic concentration, in order to "set" the asbestos diaphragm is no longer necessary. (5) The discontinuous nature of the polymer coat of the present invention on the asbestos fiber surface retains most of the desirable ion-exchange and hydraulically permeable properties of the asbestos fibers. (6) The diaphragms of the present invention do not appear as susceptible to damage by the unavoidable current fluctuations experienced during extended periods of in-plant operation. Other advantages will appear from the following.

DESCRIPTION OF THE PREFERRED EMBODIMENTS

The cathodes on which the dimensionally stable diaphragms are to be deposited are conventional to the art and generally comprise an integral part of the cathode can, traversing the width of the cell and being designed to interleave in an alternate fashion with a plurality of vertically disposed anodes. Exemplary of such cathodes are those described in U.S. Pat. No. 2,987,463. These cathodes are foraminous in nature, e.g., mesh, perforated sheet or expanded metal, usually being constructed of a wire screen, especially steel, and define an interior catholyte chamber.

Generally, such cathodes are provided with an asbestos diaphragm by immersion in a slurry of asbestos fibers followed by drawing a vacuum on the catholyte chamber, resulting in the desired deposition of the fibers in question, primarily on the active cathode surfaces. It is this coating operation upon which the method of the present invention improves.

The first step in the method is the preparation of the slurry of asbestos fibers and particulate thermoplastic polymer material in an appropriate liquid media.

The asbestos fibers employed are conventional and well known to the art. No particular high quality grade of asbestos fibers is required. In fact, because of the adhesive and cohesive properties of the polymer to be incorporated, it is possible to use a lower grade fiber than when these properties must be provided by the asbestos alone.

The polymer employed is generally any thermoplastic material chemically and mechanically resistant to the cell environment and available in a particulate form, that is, as granules or particles within a preferred size range of 0.05 to 200 microns in diameter or as fibers preferably having a denier from 1.0–100, preferably 1.0–10; a tenacity of from 0.1–10, preferably 1.0–3.0; and a length of from 0.01–1.0 inch, preferably 0.25–0.75. Of course, mixtures of fibers and granules, as well as granules and fibers of different sizes and lengths, respectively, may be used to advantage.

As these thermoplastic polymers, particularly to be preferred are the fluorocarbons such as polyvinyl fluoride, polyvinylidene fluoride, polytetrafluoroethylene, polyperfluoroethylene propylene, polychlorotrifluoroethylene.

The liquid medium in which the slurry is provided is essentially aqueous. This may be water, brine, or cell liquor, synthetic or natural (e.g., containing about 15 percent NaCl and 15 percent NaOH), or mixtures thereof.

Generally, a surfactant is employed to wet the materials, especially the polymer. This may be essentially any of the numerous known wetting agents, e.g., a nonionic surfactant such as octyl phenoxy polyethoxy ethanol.

The slurries of the present invention generally contain from 5 to 30 grams per liter solids (asbestos plus polymer) and from 0.01–0.1 percent surfactant. The amount of polymer to be employed is that sufficient to prevent substantial swelling of the asbestos diaphragm in use. This amount will vary with the identity of the polymer and particularly with its physical form. Thus, in the case of fibers, the longer the polymer fiber, the more must be used. For example, with a 0.25 inch average fiber length, 25 percent by weight of polymer, on an asbestos plus polymer basis, may be required to obtain a suitable diaphragm while with a 0.5 inch fiber of the same identity and denier, up to 50 percent may be required to achieve the same effect. When employing a granular polymer, much less may be required, e.g., 5.0–15 percent, depending again on particle size. Obviously, this suggests that polymer fiber-granule mixtures are useful in some instances. Generally, the particulate polymer will constitute from 1.0–70, preferably 5.0–70, percent by weight of the asbestos-polymer total.

A typical "polymer fiber" recipe employs 15 grams asbestos fibers, 5 grams polytetrafluoroethylene fibers, and 0.05 gram surfactant in one liter of a cell liquor containing about 15 percent each of NaCl and NaOH.

A typical "granular" polymer recipe employs 15 grams asbestos fibers, 1.64 grams polyvinylidene fluoride, and 0.74 gram dioctyl sodium sulfosuccinate in one liter of water.

When a uniform slurry has been obtained, the cathode or cathodes to be coated are immersed therein, optionally with agitation of the slurry, and a vacuum is applied through the cathode chamber. Initially, the vacuum may vary from about 1.0–10 inches, later increasing to capacity, e.g., 25 inches, until a sufficient, uniform coating is obtained. The thus-coated cathode is then removed and dried at a temperature of about 95° C. In this manner, a diaphragm typically having a thickness of from 30 to 125 mils is obtained.

The next step is that of fusing the polymer at a temperature dependent upon the identity of the thermoplastic material employed. Generally, this temperature, which may be readily determined by one skilled in the art in any particular instance, is that sufficient to cause the polymer to soften and flow but insufficient to lead to any significant decomposition of the polymeric material. Such a temperature may be achieved merely by inserting the coated cathode into an oven. It is important that the entire coating be allowed to reach the requisite temperature in order to assure maximum and complete polymer fusion. Owing to the particulate nature of the thermoplastic polymer employed, a discontinuous polymer coating is thus obtained on the surface of the asbestos fibers, which coating generally serves to fuse adjacent asbestos fibers together at their points of intersection. Additionally, when the particulate polymer is also fibrous, a fused polymer lattice is formed, providing a further interlocking effect. The diaphragm coated cathode is then allowed to cool to room temperature for assembly in the cell.

The product of the above-described process is a uniform, adherent, and coherent diaphragm coating directly on the cathode, which coating normally swells less than about 25 percent under operating cell conditions and has a permeability and separator efficiency such that at 1 a.s.i. and an anolyte head of from 3 to 20 inches, there follows at least a 135 gram per liter caustic concentration at a minimum cathode caustic efficiency of 95 percent. It is interesting to note that when the particulate form of the polymer is fibrous, essentially none of the diaphragm extends through the plane defined by the mesh cathode and into the catholyte chamber. The significance of this is an improved hydrogen gas release over that obtained with conventional asbestos diaphragms, which are partially pulled through this plane by the vacuum deposition step, and ease of removal of the diaphragm when desired.

In order that those skilled in the art may more readily understand the present invention and certain preferred embodiments by which it may be carried into effect, the following specific examples are afforded.

EXAMPLE 1

A slurry is prepared by adding 5 grams of polytetrafluoroethylene fibers (6.67 denier, 0.25 inch long) to 1 liter of aqueous cell liquor (containing approximately 15% each NaOH and NaCl) together with 0.05 gram of Triton X-100 (trademark of Rohm and Haas for a nonionic octyl phenoxy polyethoxy ethanol surfactant). After mixing until the polymer fibers are completely wetted, 15 grams of asbestos fibers (2 parts Hooker Two:1 part Hooker One fibers from General Aniline and Film). Mixing is continued to obtain a uniform slurry.

The mesh cathode (0.093 inch steel wire calendered to a thickness of 0.155 inch) is immersed in the slurry and a vacuum ranging from 0–2.5 inches (Hg gauge) is pulled for about 5 minutes, followed by an increase to full vacuum (about 28 inches) for an additional 10 minutes. The coated cathode is then removed, subjected to full vacuum for 30 minutes, dryed at 95° C. for one hour, and heated at 370° C. for one hour to fuse the polymer.

The disphragm coated cathode so prepared is employed opposite and spaced 0.5 inch from the dimensionally stable anode of a laboratory cell employing saturated brine as the anolyte at an operating temperature of about 90° C. As compared to an unmodified (i.e., no polymer) asbestos coated cathode under like conditions, a voltage reduction of 150 millivolts is obtained. While the unmodified asbestos diaphragm is badly swollen after only 160 hours, substantially no swelling is visible after 775 hours with the polymer modified diaphragm coated cathode.

EXAMPLE 2

Following the procedure of Example 1 but employing 50 weight percent of 0.5 inch long polytetrafluoroethylene fibers of the same denier, a diaphragm coated cathode is obtained. This cathode operates at a 98% separator efficiency and a 240 millivolt advantage over a comparable unmodified asbestos diaphragm for in excess of 2,700 hours.

EXAMPLE 3

A slurry is prepared consisting of 60 grams of Hooker Two asbestos fibers, 3.0 grams of dioctyl sodium sulfosuccinate and 6.6 grams of Kynar 7201 (trademark of Pennwalt Corporation for a polyvinylidene fluoride-polytetrafluoroethylene copolymer having a particle size of about 5 microns) in 8 liters of water. The diaphragm is deposited on the cathode according to the method of Example 1, followed by drying for 30 minutes at 125° C. and curing for 30 minutes at 260° C. The resultant diaphragm coated cathode is found to have excellent permeability and voltage properties as compared to a conventional asbestos diaphragm.

EXAMPLE 4

A slurry is prepared by mixing 20 grams of Teflon 30B (trademark of E. I. duPont deNemours and Company for an aqueous dispersion of polytetrafluoroethylene having a particle size range of 0.05–0.5 micron with a nonionic surfactant) and 36 grams Hooker One and 72 grams Hooker Two asbestos fibers in 2 liters of water for 10 minutes, followed by the addition of 2.5 liters of water and 1.5 liters cell liquor (about 15% NaOH and 15% NaCl). The diaphragm is deposited according to the method of Example 1 with drying for 30 minutes at 150° C., followed by curing for 30 minutes at 370° C. The resultant diaphragm coated cathode performs to advantage in an electrolytic chlor-alkali cell.

Repetition of this example substituting 4 liters of water and 4 liters saturated brine as a slurry medium yields like results.

We claim:

1. A method of providing a hydraulically permeable dimensionally stable diaphragm on a foraminous chlor-alkali electrolytic cell cathode, which method comprises:

(a) forming a slurry of fibrous asbestos and a particulate thermoplastic fluorine-containing polymer mechanically and chemically resistant to the cell environment by mixing together said asbestos and polymer, said polymer being present in an amount sufficient to prevent substantial swelling of the diaphragm;

(b) inserting the cathode to be coated into said slurry and depositing a uniform mixture of asbestos fibers and particulate polymer thereon by means of a vacuum;

(c) removing the coated cathode from the slurry and subjecting same to a temperature sufficient to allow the polymer to fuse and flow, without the application of pressure, and cause the polymer to bind adjacent fibers together without forming a continuous polymer coating on the fiber surface; and (d) cooling the diaphragm coated cathode to substantially room temperature whereby there is obtained a diaphragm, dimensionally stable under operating cell conditions, characterized by asbestos fibers bearing a discontinuous fused polymer coating thereon.

2. A method as in claim 1 wherein the polymer constitutes from 5 to 70 percent by weight of the polymer-asbestos total.

3. A method as in claim 1 wherein the concentration of asbestos plus polymer in the slurry is within the range of 5 to 30 grams per liter.

4. A method as in claim 1 wherein the coated cathode surface is substantially dried before subjecting same to the polymer fusion temperature.

5. A method as in claim 1 wherein the particulate polymer constitutes a mixture of polymeric fibers and granules.

6. A method of providing a hydraulically permeable dimensionally stable diaphragm on a foraminous chlor-alkali electrolytic cell cathode which method comprises:

(a) forming a slurry of fibrous asbestos and a fibrous thermoplastic fluorine-containing polymer mechanically and chemically resistant to the cell environment by mixing together said asbestos and polymer, said polymer being present in an amount sufficient to prevent substantial swelling of the diaphragm;

(b) inserting the cathode to be coated into said slurry and depositing a uniform mixture of asbestos and polymer fibers thereon by means of a vacuum;

(c) removing the coated cathode from the slurry and subjecting same to a temperature sufficient to allow the polymer to fuse and flow, without the application of pressure, and cause the polymer to bind adjacent fibers together without forming a continuous polymer coating on the asbestos fiber surface; and (d) cooling the diaphragm coated cathode to substantially room temperature whereby there is obtained a diaphragm, dimensionally stable under operating cell conditions, chaaracterized by asbestos fibers bearing a discontinuous polymer coating thereon, said asbestos fibers being bound together by a fused polymer fiber lattice.

7. A method as in claim 6 wherein said polymer fibers have a denier from 1.0 to 100, a tenacity of from 0.1 to 10 gpd, and a length of from 0.01 to 1.0 inch.

8. A method as in claim 6 wherein the polymer is polytetrafluoroethylene.

9. A method as in claim 6 wherein the amount of polymer fiber constitutes from 5 to 70 percent of the asbestos-polymer total.

10. A method of providing a hydraulically permeable dimensionally stable diaphragm on a foraminous chlor-alkali electrolytic cell cathode which method comprises:

(a) forming a slurry of fibrous asbestos and a granular thermoplastic fluorine-containing polymer mechanically and chemically resistant to the cell environment by mixing together said asbestos and polymer, said polymer being present in an amount sufficient to prevent substantial swelling of the diaphragm;

(b) inserting the cathode to be coated into said slurry and depositing a uniform mixture of asbestos fibers and polymer granules thereon by means of a vacuum;

(c) removing the coated cathode from the slurry and subjecting same to a temperature sufficient to allow the polymer to fuse and flow, without the application of pressure, and cause the polymer to bind adjacent fibers together without forming a continuous polymer coating on the fiber surface; and (d) cooling the diaphragm coated cathode to substantially room temperature whereby there is obtained a diaphragm, dimensionally stable under operating cell conditions, characterized by asbestos fibers bearing a discontinuous polymer coating thereon and fused with polymer at the points of fiber intersection.

11. A method as in claim 10 wherein the particle size of the polymer granules is within the range of 0.05 to 200 microns.

12. A method as in claim 10 wherein the polymer is polytetrafluoroethylene.

13. A method as in claim 1 wherein said particulate thermoplastic polymer is a polyfluorocarbon.

14. The diaphragm-coated cathode product of the process of claim 1.

15. A method as in claim 1 wherein the polymer is polyvinylidene fluoride.

16. A method as in claim 1 wherein the polymer is polyperfluoroethylene propylene.

17. A method as in claim 1 wherein the polymer is polychlorotrifluoroethylene.

18. A method as in claim 1 wherein the polymer is polychlorotrifluoroethylene-polyethylene copolymer.

19. A method as in claim 1 wherein the polymer is polytetrafluoroethylene.

20. A method as in claim 1, wherein said temperature is sufficient to cause the polymer to soften and flow, and insufficient to lead to any significant decomposition of the polymeric material.

21. A method as in claim 6, wherein said temperature is suffficient to cause the polymer to soften and flow, and insufficient to lead to any significant decomposition of the polymeric material.

22. A method as in claim 10, wherein said temperature is sufficient to cause the polymer to soften and flow and insufficient to lead to any significant decomposition of the polymeric material.

* * * * *

UNITED STATES PATENT AND TRADEMARK OFFICE

CERTIFICATE OF CORRECTION

PATENT NO. : 4,410,411

DATED : October 18, 1983

INVENTOR(S) : Fenn, III et al

It is certified that error appears in the above-identified patent and that said Letters Patent are hereby corrected as shown below:

Column 1, line 31, a period should be inserted after "polymer."

Column 3, line 30, after "ethylene" there should be added --and polychlorotrifluoroethylene-ethylene copolymers--.

Column 5, line 7, "disphragm" should read --diaphragm--.

In the claims:

Claim 18, line 2, that portion of the copolymer reading "polyethylene" should read --ethylene--.

Signed and Sealed this

Tenth Day of April 1984

[SEAL]

*Attest:*

GERALD J. MOSSINGHOFF

*Attesting Officer*

*Commissioner of Patents and Trademarks*